US006447260B1

(12) United States Patent
Eller et al.

(10) Patent No.: US 6,447,260 B1
(45) Date of Patent: Sep. 10, 2002

(54) EXTENDABLE MOBILE PUMPING APPARATUS

(76) Inventors: James David Eller, 201 N. Federal Highway, 2nd Floor, Deerfield Beach, FL (US) 33441-2013; Dana J. Eller, 201 N. Federal Highway, 2nd Floor, Deerfield Beach, FL (US) 33441-2013; Daren J. Eller, 201 N. Federal Highway, 2nd Floor, Deerfield Beach, FL (US) 33441-2013

( * ) Notice: Subject to any disclaimer, the term of this patent is extended or adjusted under 35 U.S.C. 154(b) by 0 days.

(21) Appl. No.: 09/444,626

(22) Filed: Nov. 22, 1999

(51) Int. Cl.[7] ..... F04B 53/00; F04B 19/00; F16L 55/00; F16L 9/18

(52) U.S. Cl. ..... 417/234; 417/211; 138/108; 138/112

(58) Field of Search ..... 417/234, 211; 138/108, 112

(56) References Cited

U.S. PATENT DOCUMENTS 3,270,677 A * 9/1966 Eller et al. ..... 415/195
4,070,135 A * 1/1978 Eller ..... 417/234
4,375,943 A * 3/1983 Stuart ..... 417/231
4,616,979 A * 10/1986 Hynes et al. ..... 417/231

* cited by examiner

*Primary Examiner*—Charles G. Freay
*Assistant Examiner*—Michael K. Gray
(74) *Attorney, Agent, or Firm*—Oltman, Flynn & Kubler

(57) ABSTRACT

A pumping apparatus for delivering water upwardly from a holding area and over a holding area bank includes a trailer having wheels and a trailer bed; a composite water drawing pipe including structure for telescoping from a shorter pipe transport length to a longer pipe deployment length to access water at lower levels in the holding area; a water drawing pipe movement mechanism including a mechanism for moving the drawing pipe between a transport position on top of the trailer bed and a deployed position substantially behind and angling downwardly from the trailer bed into water in the holding area. The composite water delivery pipe preferably includes a wider outer pipe and a narrower inner pipe, at least a portion of the narrower inner pipe being slidably retained within the wider outer pipe, the narrower inner pipe being mounted on an annular guiding carriage extending radially between the outer pipe and the inner pipe.

10 Claims, 5 Drawing Sheets

EXTENDABLE MOBILE PUMPING APPARATUS

BACKGROUND OF THE INVENTION

1. Field of the Invention

The present invention relates generally to the field of pumping mechanisms. More specifically the present invention relates to a flat-bed trailer mounted pumping apparatus for drawing water from a low lying holding area and delivering the water upwardly to and over a bank on which the trailer rests to any designated receiving area or means.

The apparatus includes a water drawing pipe and a deployment and angling cable means which moves the drawing pipe between a transport position on the trailer bed and a deployed position behind and angling downwardly from the bed into the water in the given holding area. A key inventive feature is that the drawing pipe telescopes from a shorter transport length to a longer deployment length to access water in deeper holding areas. A telescoping cable means moves an inner pipe segment into and out of an outer pipe segment. A hydraulic motor drives an impeller contained within the intake end of the drawing pipe. The hydraulic motor is in fluid communication with and powered by a hydraulic pump with a pressurized reservoir on the trailer bed.

2. Description of the Prior Art

There have been water pump assemblies for gathering water from holding areas and delivering the water at a high flow rate to a receiving area. The most notable such pump assembly is U.S. Pat. No. 3,270,677 issued on Sep. 6, 1966 to the present applicant, which functions very effectively, but is limited as to the depth of water it can reach in a holding area.

It is thus an object of the present invention to provide a water pumping apparatus which can reach and gather water in a deep holding area through a water drawing pipe longer than a trailer bed on which the pumping elements rest during apparatus transport.

It is another object of the present invention to provide such an apparatus in which the water drawing pipe telescopingly retracts to become shorter to fit compactly onto the apparatus trailer bed.

It is still another object of the present invention to provide such an apparatus which extends and retracts the water drawing pipe automatically through user operation of controls.

It is finally an object of the present invention to provide such an apparatus which is relatively inexpensive to manufacture and maintain, and which is reliable.

SUMMARY OF THE INVENTION

The present invention accomplishes the above-stated objectives, as well as others, as may be determined by a fair reading and interpretation of the entire specification.

A pumping apparatus is provided for delivering water upwardly from a holding area and over a holding area bank, including a trailer having wheels and a trailer bed; a composite water drawing pipe including structure for telescoping from a shorter pipe transport length to a longer pipe deployment length to access water at lower levels in the holding area; a water drawing pipe movement mechanism including a mechanism for moving the drawing pipe between a transport position on top of the trailer bed and a deployed position substantially behind and angling downwardly from the trailer bed into water in the holding area.

The composite water delivery pipe preferably includes a wider outer pipe and a narrower inner pipe, at least a portion of the narrower inner pipe being slidably retained within the wider outer pipe, the narrower inner pipe being mounted on an annular guiding carriage extending radially between the outer pipe and the inner pipe. The annular guiding carriage preferably includes an annular carriage plate encircling and connected to the inner pipe and having a plate inner circumference and a plate outer circumference; at least one carriage wheel mounted to the carriage plate at the plate outer circumference to permit the carriage plate and the inner pipe to ride on the carriage wheel as the inner pipe moves longitudinally within the outer pipe.

Where the outer pipe has a remote end and the inner pipe has an outer surface, the apparatus preferably additionally includes an annular outer pipe end flange structure; the end flange structure including an outer pipe end flange connected to and extending radially inward from the outer pipe remote end toward the inner pipe outer surface, the end flange having a lower end and an inner circumference; the end flange structure further including at least one inner pipe support wheel mounted to the end flange lower end and extending radially inward from the end flange inner circumference; where at least part of the weight of the inner pipe rides on the inner pipe support wheel as the inner and outer pipes telescope.

The apparatus preferably additionally includes a drawing pipe retraction cable secured at one end to the inner pipe intake end and extending along and substantially parallel to the drawing pipe to a retraction pulley rotatably secured to the trailer bed, the retraction pulley being rotatable by an electric motor; so that gathering the retraction cable on the retraction pulley causes the drawing pipe to telescope to a shorter configuration and unwinding the retraction cable from the retraction pulley permits the weight of the inner pipe to advance the inner pipe out of the outer pipe toward and into the water in the holding area and thereby telescope the drawing pipe to a longer configuration.

The apparatus preferably still additionally includes an angling cable guide pulley rotatably mounted on a guide pulley arm structure secured relative to the trailer; an angling cable gathering pulley mounted on a gathering pulley arm structure secured relative to the trailer; a drawing pipe angling cable connected to the remote end of the outer pipe and angling upwardly onto and over the angling cable guide pulley and over the trailer bed and being secured to the angling cable gathering pulley; an angling cable gathering motor drivably connected to the angling cable gathering pulley; a drawing pipe fulcrum structure connected to the trailer bed, pivotally securing the drawing pipe discharge end to the trailer bed; so that operation of the angling cable gathering motor to rotate the angling cable gathering pulley to gather the angling cable causes the drawing pipe remote end to pivot on the fulcrum structure upwardly and away from the water in the holding area, and operation of the motor to unwind the angling cable from the gathering pulley permits the weight of the water drawing pipe to pivot the outer pipe remote end downwardly about the pivotally connected end toward the water in the holding area, until a desired angle of descent is achieved.

The pump apparatus preferably includes an impeller with an impeller drive shaft rotatably mounted to an impeller mounting structure secured within the intake end of the inner pipe, and a hydraulic motor drivably connected to the impeller drive shaft; a hydraulic pump secured relative to the trailer; and a hydraulic line extending from the hydraulic pump along the drawing pipe to the inner pipe intake end and connecting to the hydraulic motor to power the hydraulic motor and thereby rotate the impeller.

The apparatus preferably still further includes downwardly telescoping hydraulic leg assemblies connected to the hydraulic pump by a hydraulic leg conduit, the telescoping hydraulic leg assemblies being secured to the trailer and oriented so that delivery of pressurized hydraulic fluid from the hydraulic pump into the telescoping hydraulic leg assemblies causes the telescoping hydraulic leg assemblies to extend to and bear against the ground, and then to elevate at least a portion of the trailer to prevent movement of the trailer relative to the ground during pumping. The water drawing pipe has a discharge end, and preferably additionally includes a collapsible water discharge hose sealingly secured to the composite water drawing pipe discharge end and extending longitudinally over, while resting on the upper surface of, the trailer bed, and extending beyond the trailer bed and terminating at a hose discharge end. The apparatus preferably still additionally includes a hose gathering spool rotatably mounted on a spool mounting structure secured relative to the trailer, the hose gathering spool being connected to a spool motor, where the collapsible water discharge hose is connected to the hose gathering spool; so that operation of the spool motor in one rotational direction rotates the hose gathering spool to gather the hose while the hose flattens as it rides onto the hose gathering spool, and operation of the spool motor in the other rotational direction rotates the hose gathering spool to unwind the hose for deployment across the trailer bed and onto the ground.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
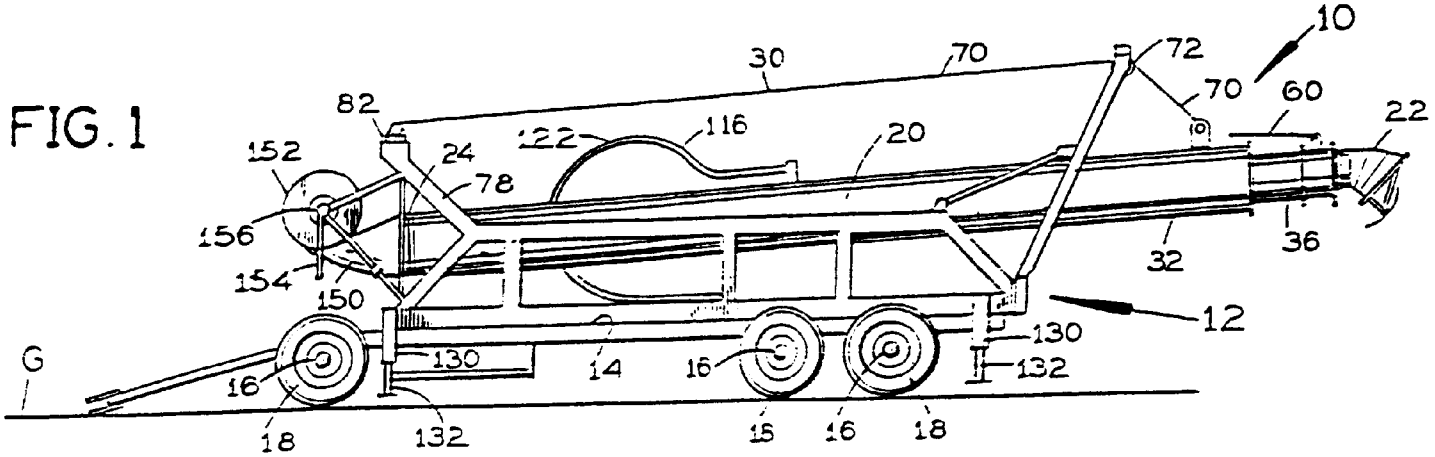
FIG. 1 is a side view of the inventive pumping apparatus, shown with the telescoping water drawing pipe in its retracted mode.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Figure 2:
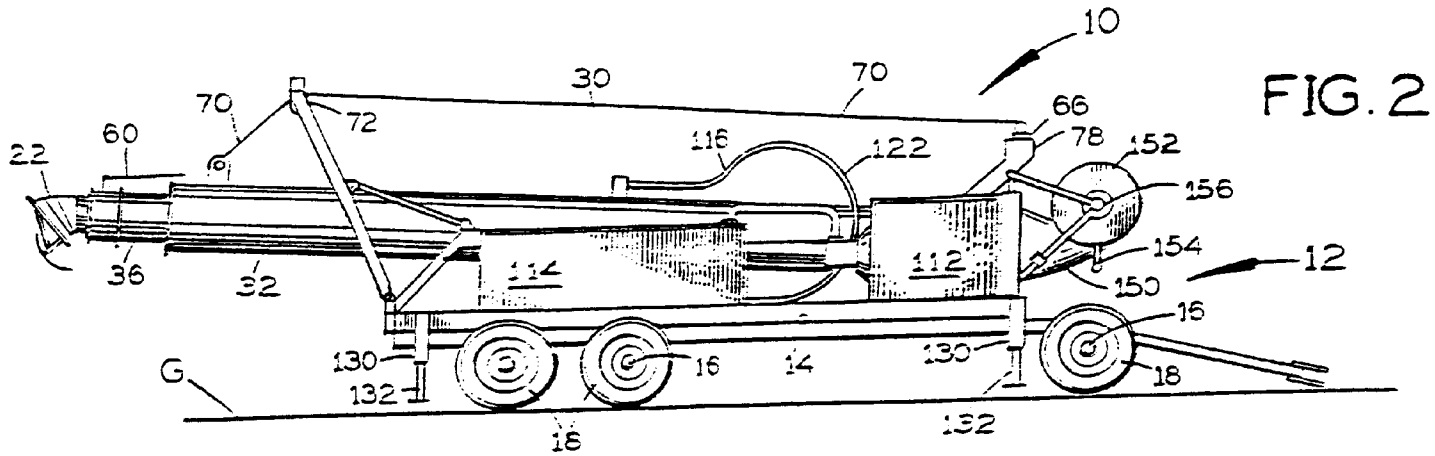
FIG. 2 is a view of the side of the apparatus opposite the view of FIG. 1.
Figure 3:
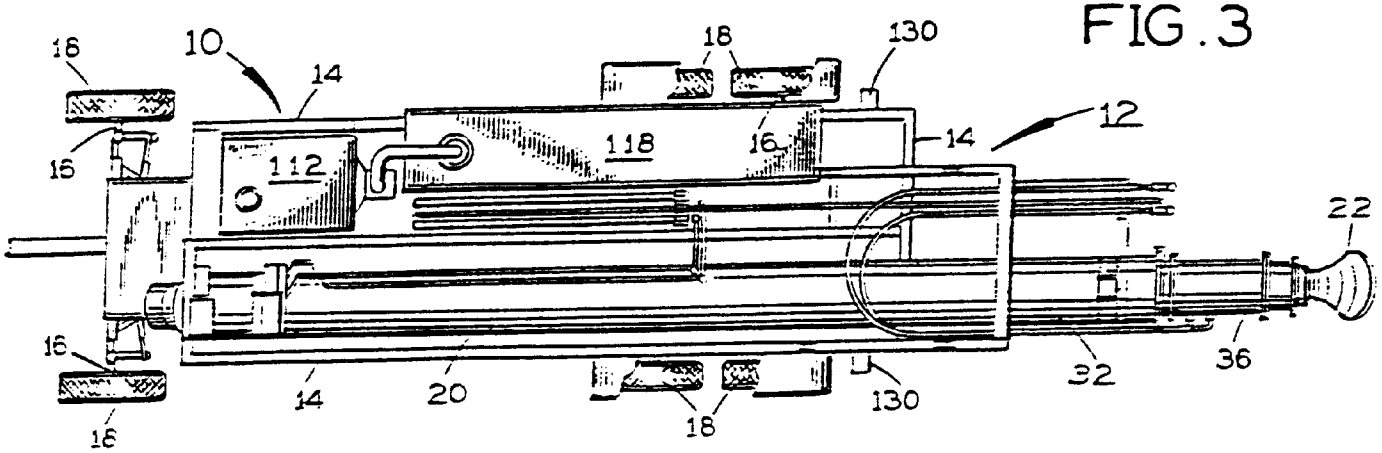
FIG. 3 is a top view of the apparatus, with the hydraulic elements shown partly in broken lines.
Figure 5:
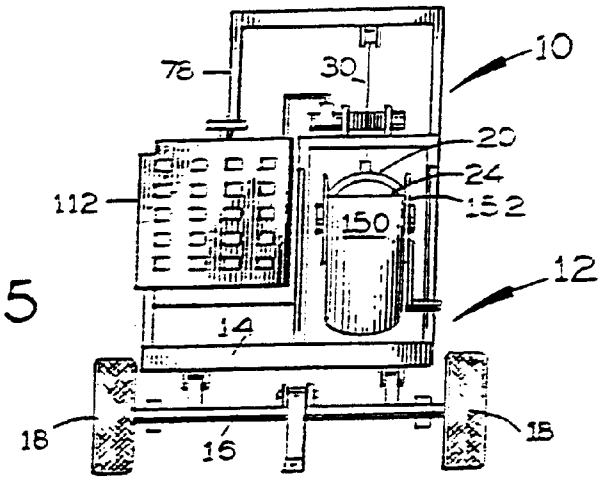
FIG. 5 is a water discharge end view of the apparatus.
Figure 4:
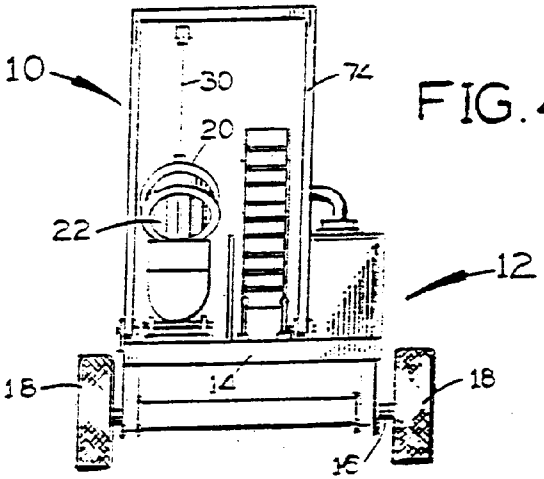
FIG. 4 is a water drawing pipe end view of the apparatus.
Figure 6:
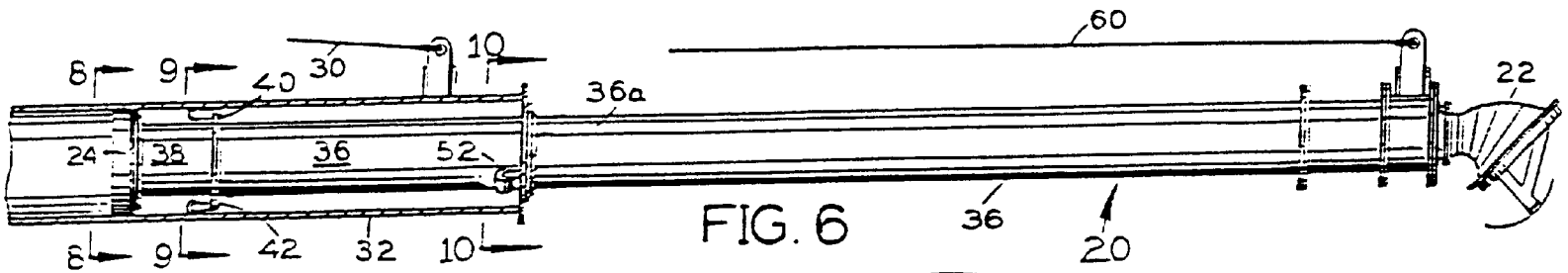
FIG. 6 is a broken away side view of the water drawing pipe in its telescopically extended mode.
Figure 9:
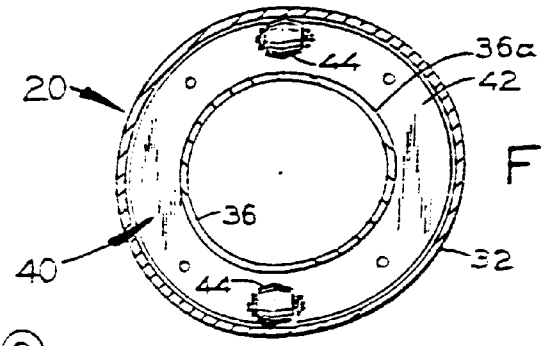
FIG. 9 is a cross-sectional view of the water drawing pipe taken along line 9—9 in FIG. 6, showing the wheel side of the carriage plate and carriage wheels.
Figure 8:
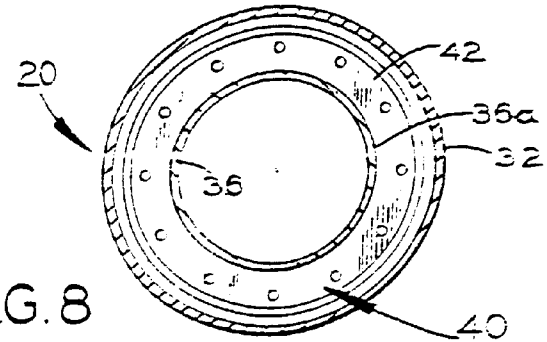
FIG. 8 is a cross-sectional view of the water drawing pipe taken along line 8—8 in FIG. 6, showing the non-wheel side of the carriage plate.
Figure 10:
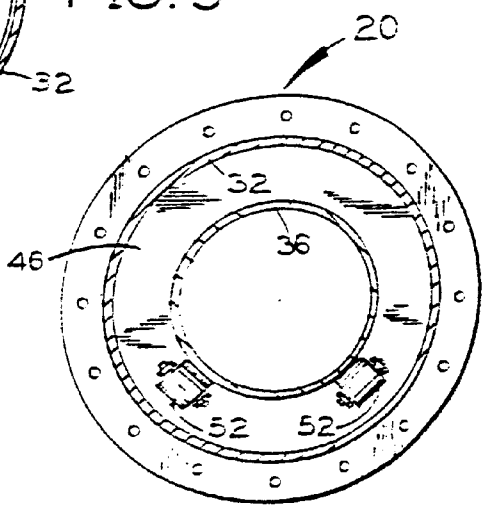
FIG. 10 is a cross-sectional view of the water drawing pipe taken along line 10—10 in FIG. 6, showing the annular outer pipe flange and flange wheels.
Figure 7:
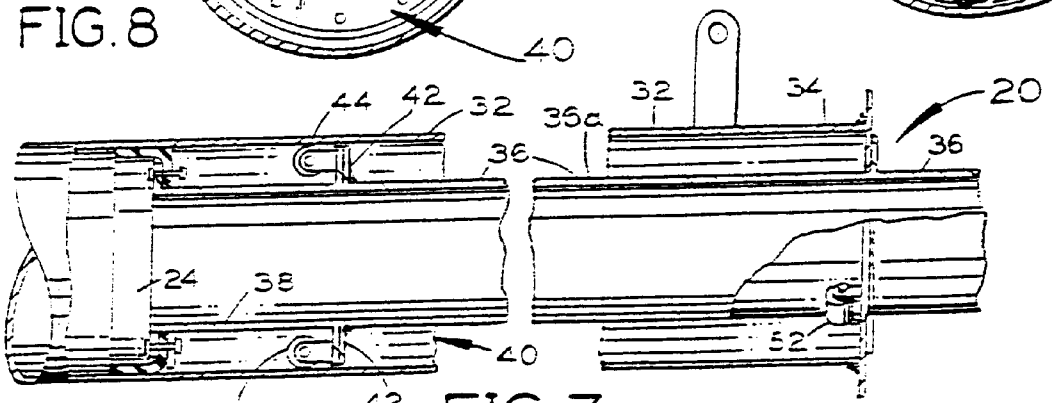
FIG. 7 is a cut-away close up of the outer pipe of the water drawing pipe, showing the carriage plate and wheels and the annular outer pipe flange and wheel.
Figure 11:
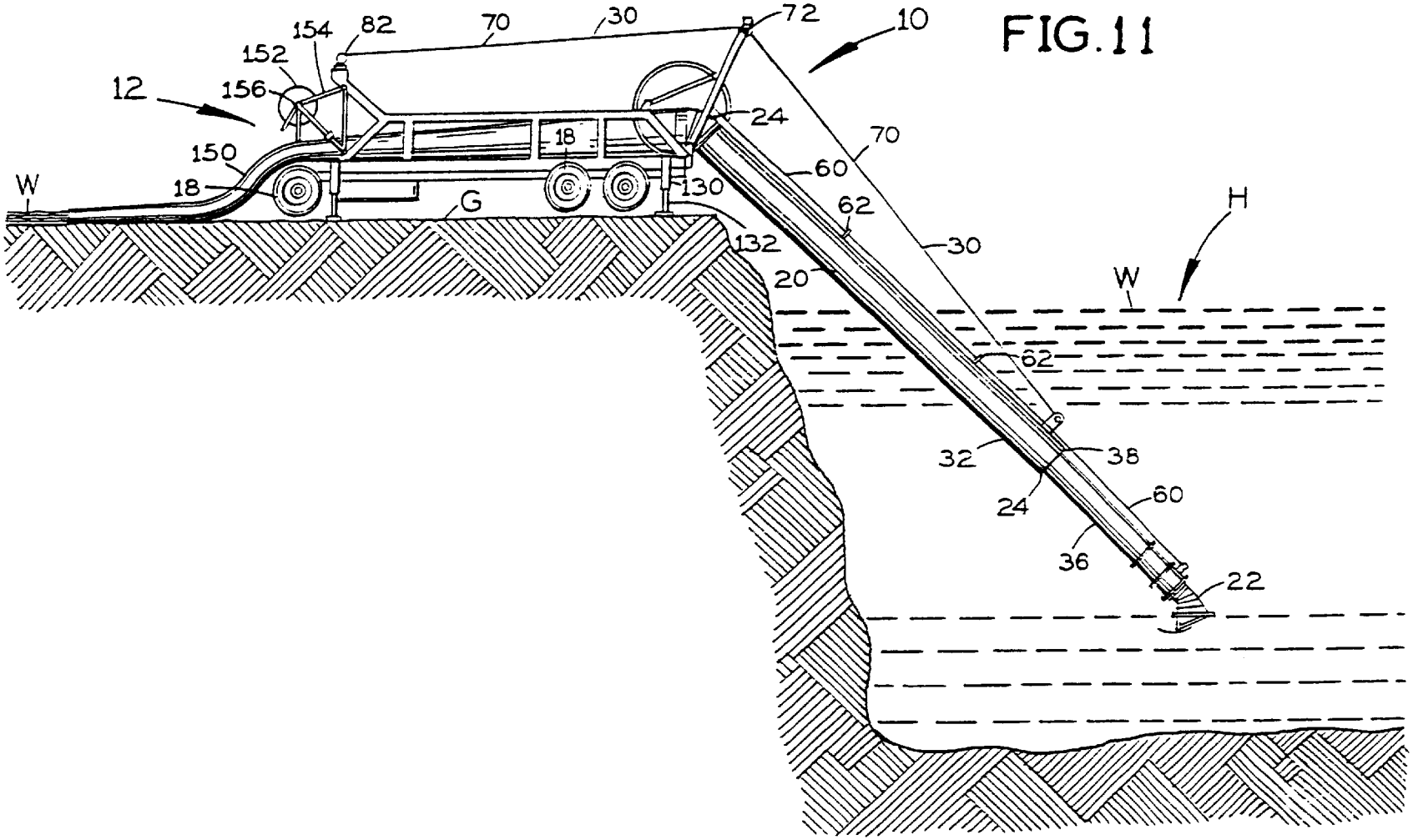
FIG. 11 is a side view of the apparatus, shown on the bank of a body of water with the water drawing pipe telescopically extended into the water and the water being pumped through the apparatus and discharged into a receiving area beyond the bank through the water discharge hose.
Figure 12:
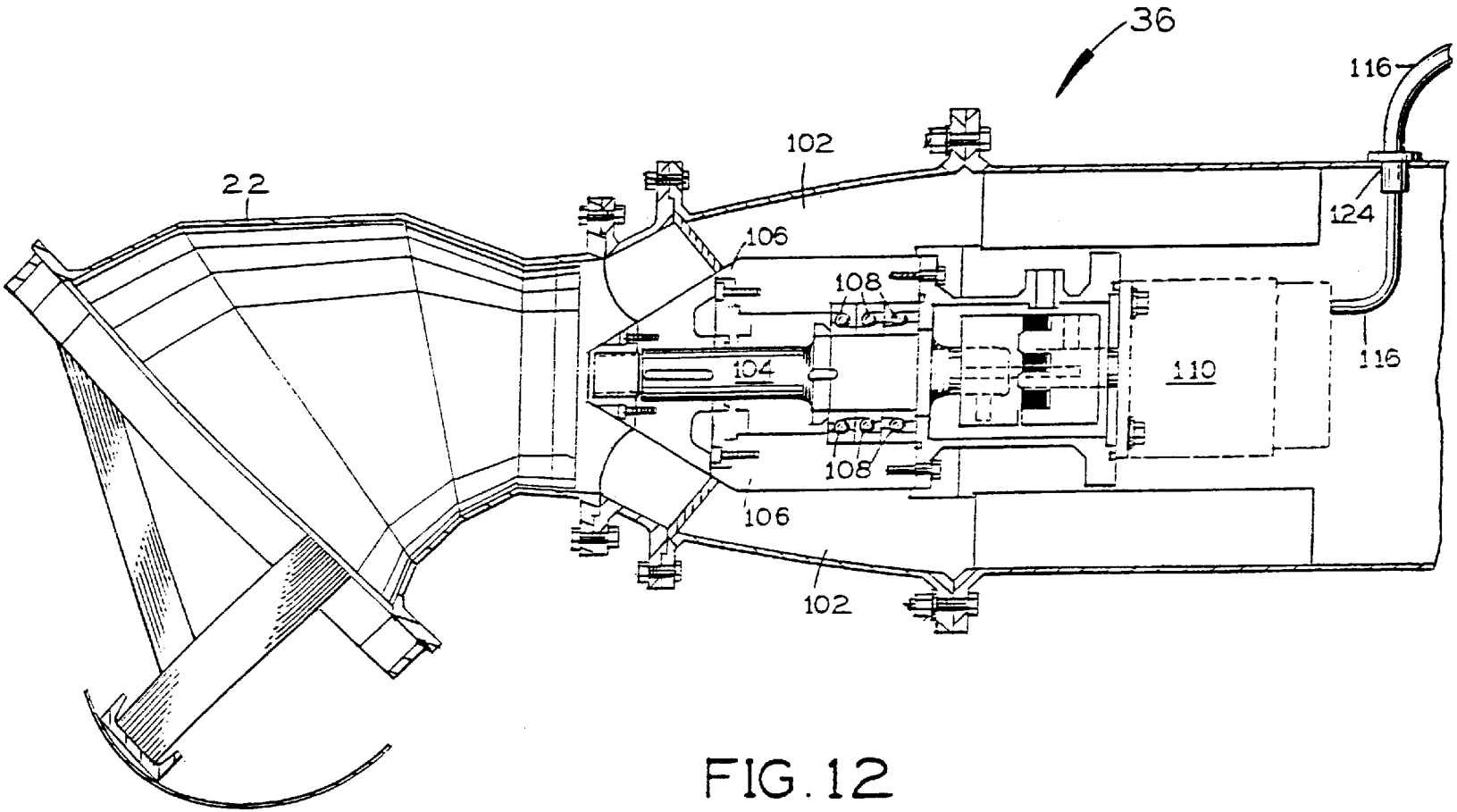
FIG. 12 is a cross-sectional side view of the water drawing pipe intake end, revealing the impeller, the impeller mounting structure, impeller drive shaft and hydraulic motor.

Referring to FIGS. 1–12, a flat-bed trailer mounted pumping apparatus 10 is disclosed, for drawing water W from a low lying holding area H and delivering the water upwardly to and beyond a bank on which the trailer 12 rests to any designated receiving area or means. The contents of U.S. Pat. No. 3,270,677 issued on Sep. 6, 1966 to the present applicant are incorporated by reference into the present application.

Trailer 12 is preferably a portion of a conventional flat bed tractor trailer combination, having a trailer bed 14 mounted on two axles 16 at the rear, and one axle 16 at the front, each end of each axle being fitted with double tire and wheel combinations 18. Apparatus 10 includes a water drawing pipe 20 having an intake end 22 and a discharge end 24, and deployment and angling cable means 30 for moving the drawing pipe 20 between a transport position on the trailer bed 14 and a deployed position behind and angling downwardly from the bed 14 into the water W in the given holding area H. A key inventive feature is that drawing pipe 20 telescopes from a shorter transport length to a longer deployment length to access water W in deeper holding areas. To this end, water drawing pipe 20 comprises a wider outer pipe 32 including discharge end 24 and a receiving end 34 and a narrower inner pipe 36 having a contained end 38 and the intake end 22 and is mounted on an annular sealing carriage 40 slidably retained within the outer pipe. The annular sealing carriage 40 includes an annular carriage plate 42 encircling and joined to the inner pipe 36 and two opposing carriage wheels 44 mounted to carriage plate 42 at the plate outer circumferential edge to permit the plate 42 and the inner pipe 36 to ride on carriage wheels 44 as inner pipe 36 moves within outer pipe 32. To further seal the space between inner and outer pipes 36 and 32, respectively, and to provide further guidance during relative movement of inner and outer pipes 36 and 32, an annular outer pipe end flange 46 extends radially inward from the outer pipe receiving end 34 into close proximity with the inner pipe 36 outer surface 36*a*. A pair of inner pipe support flange wheels 52 are mounted along the lower edge of end flange 46, along the flange 46 inner circumference. As the inner and outer pipes 36 and 32 telescope, part of the weight of the inner pipe 36 rides on the carriage 40 and flange wheels 52.

A drawing pipe retraction cable 60 is secured to the inner pipe intake end 22 and extends along and substantially parallel to the composite drawing pipe 20, through loop bolt heads 62 on outer pipe 32, to a retraction cable pulley 64 rotatably secured to trailer bed 14 and rotated by a retraction cable pulley electric motor 66. Gathering the retraction cable 60 on the retraction cable pulley 64 causes the drawing pipe 20 to telescope to a shorter configuration and unwinding the retraction cable 60 from the retraction cable pulley 64 permits the weight of the downwardly angled inner pipe 36 to telescope the drawing pipe 20 to a longer configuration by advancing the inner pipe 36 out of the outer pipe 32 toward and partly into the water W in the holding area H.

A drawing pipe deployment and angling cable 70 is connected to the remote end of the outer pipe 32 and angles upwardly onto and over a cable guide pulley 72 rotatably mounted on a guide pulley arm structure 74 on the trailer 12 and over the trailer bed 14 to an angling cable gathering pulley 76 mounted on a gathering pulley arm structure 78. An angling cable gathering motor 82 is drivably connected to the angling cable gathering pulley 76, so that operation of the motor 82 to gather the angling cable 70 causes the drawing pipe receiving end 34 to pivot upwardly and away from the water W in the holding area H and continued operation pulls the entire drawing pipe 20 onto the trailer bed 14. By the same token, operation of the motor 82 to unwind the angling cable 70 from the gathering pulley 76 permits the weight of the drawing pipe 20 to pivot the pipe receiving end 34 downwardly toward the water W in the holding area H, until a desired angle of descent is achieved.

The intake end 22 of the inner pipe 36 contains an impeller 102 fitted to an impeller drive shaft 104 rotatably mounted to an impeller mounting structure 106, and a hydraulic motor 110 drivably connected to the impeller drive shaft 104. See FIG. 12. Drive shaft 104 rides on drive shaft bearings 108 within mounting structure 106. A hydraulic pump 112, connected by internal hydraulic lines 118 to a hydraulic fluid reservoir 114, are provided on trailer bed 14. A flexible hydraulic line 116 extends from hydraulic pump 112, over a, segmented hose track 122 forming an arch to prevent hydraulic line collapse, through stirrups along the exterior of the telescoping water drawing pipe 20, through a lateral port 124 in inner pipe intake end 22 to hydraulic motor 110 to power the rotation of intake 102.

Downwardly telescoping, hydraulic leg mechanisms 130 of known design are secured to the two rearward corners of the trailer bed 14. Pumped delivery of hydraulic fluid from the reservoir 114 into the leg mechanisms 130 causes the legs 132 to extend to and bear against the ground G, and then to elevate the rear of the trailer bed 14 and tire and wheel combinations 18, to prevent movement of the trailer 12 during pumping.

A collapsible water discharge hose 150 is sealingly secured to the drawing pipe discharge end 24 and extends longitudinally over, while resting on the upper surface of, the trailer bed 14 and extends beyond trailer bed 14. The point of discharge end 24 termination is also the apparatus 10 water discharge point. The collapsible water discharge hose 150 is connected to a hose gathering spool 152 rotatably mounted on a spool mounting structure 154 secured to the water discharge end of trailer bed 14, and the spool 152 is connected to a spool motor which rotates the spool 152 either to gather the hose 150 while the hose 150 flattens out as it rides onto the spool 152, or to unwind the hose 150 for deployment across the trailer bed 14 as described. The spool 152 must gather the hose 150 simultaneously or subsequent to the movement of drawing pipe 20 and thus of the hose 150 connected end, onto and along the trailer bed 14, toward the spool 152.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as my invention:

1. A pumping apparatus for delivering water upwardly from a holding area and over a holding area bank, comprising:

a trailer having wheels and a trailer bed;

a composite water drawing pipe comprising a drawing pipe receiving end and means for telescoping from a shorter pipe transport length to a longer pipe deployment length to access water at lower levels in the holding area;

a water drawing pipe movement mechanism comprising means for moving said drawing pipe between a transport position on top of said trailer bed and a deployed position substantially behind and angling downwardly from said trailer bed into water in the holding area.

2. The apparatus of claim 1, wherein said composite water drawing pipe comprises:

a wider outer pipe and a narrower inner pipe at least a portion of said narrower inner pipe being slidably retained within said wider outer pipe, said narrower inner pipe being mounted on an annular guiding carriage extending radially between said outer pipe and said inner pipe and said inner pipe has an inner pipe intake end.

3. The apparatus of claim 2, wherein said annular guiding carriage comprises:

an annular carriage plate encircling and connected to said inner pipe and having a plate inner circumference and a plate outer circumference;

at least one carriage wheel mounted to said carriage plate at said plate outer circumference to permit said carriage plate and said inner pipe to ride on said carriage wheel as said inner pipe moves longitudinally within said outer pipe.

4. The apparatus of claim 3, wherein said outer pipe has an outer pipe receiving end and said inner pipe has an outer surface, additionally comprising an annular outer pipe end flange structure; said end flange structure comprising an outer pipe end flange connected to and extending radially inward from said outer pipe receiving end toward said inner pipe outer surface, said end flange having a lower end and an inner circumference; said end flange structure further comprising at least one inner pipe support wheel mounted to said end flange lower end and extending radially inward from said end flange inner circumference;

wherein at least part of the weight of said inner pipe rides on said inner pipe support wheel as said inner and outer pipes telescope.

5. The apparatus of claim 2, additionally comprising a drawing pipe retraction cable secured at one end to said inner pipe intake end and extending along and substantially parallel to said drawing pipe to a retraction pulley rotatably secured to said trailer bed said retraction pulley being rotatable by an electric motor;

such that gathering said retraction cable on said retraction pulley causes said drawing pipe to telescope to a shorter configuration and unwinding said retraction cable from said retraction pulley permits the weight of said inner pipe to advance said inner pipe out of the outer pipe toward and into the water in the holding area and thereby telescope said drawing pipe to a longer configuration.

6. The apparatus of claim 2, additionally comprising:

an angling cable guide pulley rotatably mounted on a guide pulley arm structure secured relative to said trailer;

an angling cable gathering pulley mounted on a gathering pulley arm structure secured relative to said trailer;

a drawing pipe angling cable connected to said outer pipe receiving end and angling upwardly onto and over said angling cable guide pulley and over said trailer bed and being secured to said, angling cable gathering pulley;

an angling cable gathering motor drivably connected to said angling cable gathering pulley;

a drawing pipe fulcrum connected to said trailer bed, pivotally securing said drawing pipe discharge end to said trailer bed;

such that operation of said angling cable gathering motor to rotate said angling cable gathering pulley to gather said angling cable causes said inner pipe intake end to pivot on said fulcrum means upwardly and away from the water in the holding area, and operation of said motor to unwind the angling cable from the gathering pulley permits the weight of said water drawing pipe to pivot the outer pipe receiving end downwardly about the pivotally connected end toward the water in the holding area, until a desired angle of descent is achieved.

7. The apparatus of claim 4, wherein said pump apparatus comprises:

an impeller with an impeller drive shaft rotatably mounted to an impeller mounting structure secured within said intake end of said inner pipe, and a hydraulic motor drivably connected to said impeller drive shaft;

a hydraulic pump secured relative to said trailer;

and a hydraulic line extending from said hydraulic pump along said drawing pipe to said inner pipe intake end and connecting to said hydraulic motor to power said hydraulic motor and thereby rotate said impeller.

8. The apparatus of claim 7, additionally comprising downwardly a telescoping hydraulic leg connected to said hydraulic pump by a hydraulic leg conduit, said telescoping hydraulic leg being secured to said trailer and oriented such that delivery of pressurized hydraulic fluid from said hydraulic pump into said telescoping hydraulic leg causes said telescoping hydraulic leg to extend to and bear against the ground, and then to elevate at least a portion of said trailer to prevent movement of said trailer relative to the ground during pumping.

9. The apparatus of claim 4, wherein said water drawing pipe has a discharge end, additionally comprising a collapsible water discharge hose sealingly secured to said composite water drawing pipe discharge end and extending longitudinally over, while resting on the upper surface of, said trailer bed, and extending beyond said trailer bed and terminating at a hose discharge end.

10. The apparatus of claim 9, additionally comprising a hose gathering spool rotatably mounted on a spool mounting structure secured relative to said trailer, said hose gathering spool being connected to a spool motor, wherein said collapsible water discharge hose is connected to said hose gathering spool;

such that operation of said spool motor in one rotational direction rotates said hose gathering spool to gather said hose while said hose flattens as it rides onto said hose gathering spool, and operation of said spool motor in the other rotational direction rotates said hose gathering spool to unwind said hose for deployment across said trailer bed and onto the ground.

* * * * *